US005384944A

United States Patent [19]

Minichshofer

[11] Patent Number: 5,384,944

[45] Date of Patent: Jan. 31, 1995

[54] NEEDLING PLATE WITH RECESSES ON DOWNSTREAM EDGES OF THE THROUGH HOLES

[75] Inventor: Klaus Minichshofer, Linz, Austria

[73] Assignee: Textilmaschinenfabrik Dr. Ernst Fehrer Aktiengesellschaft, Leonding, Austria

[21] Appl. No.: 146,694

[22] Filed: Nov. 1, 1993

[30] Foreign Application Priority Data

Nov. 9, 1992 [AT] Austria ..... A 2199/92

[51] Int. Cl.[6] ..... D04H 18/00

[52] U.S. Cl. ..... 28/115

[58] Field of Search ..... 28/107–115; 112/260; 38/93; 209/270, 273, 274

[56] References Cited

U.S. PATENT DOCUMENTS

| | | | |
|---|---|---|---|
| 2,729,004 | 1/1956 | Swanson | 38/93 |
| 2,846,793 | 8/1958 | Studer | 38/93 X |
| 3,473,205 | 10/1969 | Zocher | 28/107 |
| 4,035,881 | 7/1977 | Zocher | 28/112 X |
| 4,430,878 | 2/1984 | Dispennett et al. | 112/260 X |
| 4,937,924 | 7/1990 | Leuchtenmuller | 28/107 |
| 5,259,512 | 11/1993 | Czerwoniak | 209/273 |

FOREIGN PATENT DOCUMENTS

| | | | |
|---|---|---|---|
| 0672606 | 5/1952 | United Kingdom | 28/107 |

*Primary Examiner*—Clifford D. Crowder
*Assistant Examiner*—Ismael Izaguirre
*Attorney, Agent, or Firm*—Collard & Roe

[57] ABSTRACT

In order to decrease the resistance to the pulling of a nonwoven web in an apparatus for needling nonwoven webs, a perforated plate is proposed, in which at least those through holes which are formed in the perforated plate at least adjacent to its upstream end have downstream edge portions which are disposed in recesses, which are formed in that surface of the plate which faces the nonwoven web and which gradually taper to said planar surface of the plate in the downstream direction.

2 Claims, 1 Drawing Sheet

NEEDLING PLATE WITH RECESSES ON DOWNSTREAM EDGES OF THE THROUGH HOLES

BACKGROUND OF THE INVENTION

1. Field of the Invention

This invention relates to a plate having a multiplicity of through holes for receiving respective needles of an apparatus for needling a nonwoven web.

2. Description of the Prior Art

Needling apparatuses comprise vertically reciprocating needle boards, which carry needles, which penetrate the nonwoven fabric, which is moved between a perforated web support and a perforated stripper plate. The needles are formed with hooklike extensions, by which the fibers of the nonwoven web are entrained mainly in the direction in which the needles penetrate through the fabric. If the web support is constituted by a plate, which has through holes for receiving respective needles, the entraining of fibers by the penetrating needles will have the result that the bottom surface of the nonwoven web enters the through holes of the supporting plate in the form of convex knobs, particularly in the region in which the nonwoven web has not yet been consolidated to a substantial degree. Such convex knobs entering the through holes of the supporting plate increase the resistance presented to the pulling of the nonwoven web and give rise to an irregular stretching of said web because the higher resistance to the pulling of the nonwoven web may have the result that thinner portions of the web are stretched to a higher degree than thicker portions of the web.

SUMMARY OF THE INVENTION

It is an object of the invention to avoid said disadvantages and to provide for use in an apparatus for needling a nonwoven web a perforated plate which is of the kind described first hereinbefore and which by the use of simple means is so designed that the influence of the convex knobs which are formed in the web being needled particularly on the needle exit side of the web can substantially be decreased.

This object is accomplished in accordance with the invention in that at least those through holes which are formed in the perforated plate at least adjacent to its upstream end have downstream edge portions which are disposed in recesses, which are formed in that surface of the plate which faces the nonwoven web and which gradually taper to said planar surface of the plate in the downstream direction.

In the apparatus for needling a nonwoven web, the perforated plate in accordance with the invention is so arranged that it is contacted by the web and that the downstream direction is the direction of travel of the nonwoven web and the upstream end of the plate is its upstream end with respect to said direction of travel.

Because recesses are provided which in the downstream direction gradually taper to the planar surface of the perforated plate from the downstream edge portions of the through holes, said downstream edge portion owing to the presence of said recesses are recessed from the planar surface of the plate and the convex knobs are moved on gradually tapering runout surfaces before the convex knobs of the moving web are again urged against the planar surface of the plate. For this reason it is no longer necessary that the convex knobs of the nonwoven web must be pulled out of the through holes over that surface which defines the hole and is at right angles to the planar surface of the plate but the convex knobs can leave the through holes substantially without an obstruction and are guided along the gradually tapering recesses so that the resistance to the pulling of the nonwoven web is greatly reduced. This affords the advantage that an irregular stretching of the nonwoven web is substantially avoided, as is an essential requirement for a high uniformity of the nonwoven web.

Because the tendency of the nonwoven web to form convex portions on the side on which the penetrating needles emerge from the web increases with the increase of the strength which is imparted to the nonwoven web by the needling, the recesses which succeed the through holes will obviously have a maximum influence adjacent to the upstream end of the perforated plate and said influence will decrease in the direction of travel of the nonwoven web. For this reason it may be sufficient in certain cases to provide such gradually tapering recesses only at the through holes in the leading edge portion of the plate and to provide such recesses only at a few transverse holes of rows of holes.

The recess may be provided in various shapes. In an embodiment which can be manufactured in a very simple manner the recesses may be constituted by surface grooves which extend transversely to the downstream direction along the respective transverse rows of holes and the through holes may overlap the upstream longitudinal edge of said grooves. But such an embodiment has the disadvantage that the area of the surface on which the nonwoven web can contact the planar surface of the plate is decreased. If it is desired to provide for the nonwoven web a contact surface which is as large as possible, a separate recess should be associated with each through hole and the width of said recesses across each of said holes, measured at right angles to the downstream direction, should correspond to the width or diameter of the through holes measured in that direction.

DETAILED DESCRIPTION OF THE PREFERRED EMBODIMENT

Figure 1:
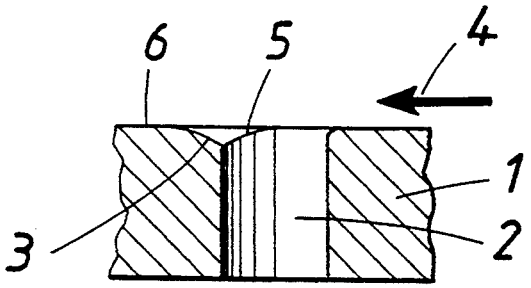
FIG. 1 is a sectional view which is taken on a line that extends in the direction of travel of the web and shows a portion of a perforated plate in accordance with the invention adjacent to a through hole.
Figure 2:
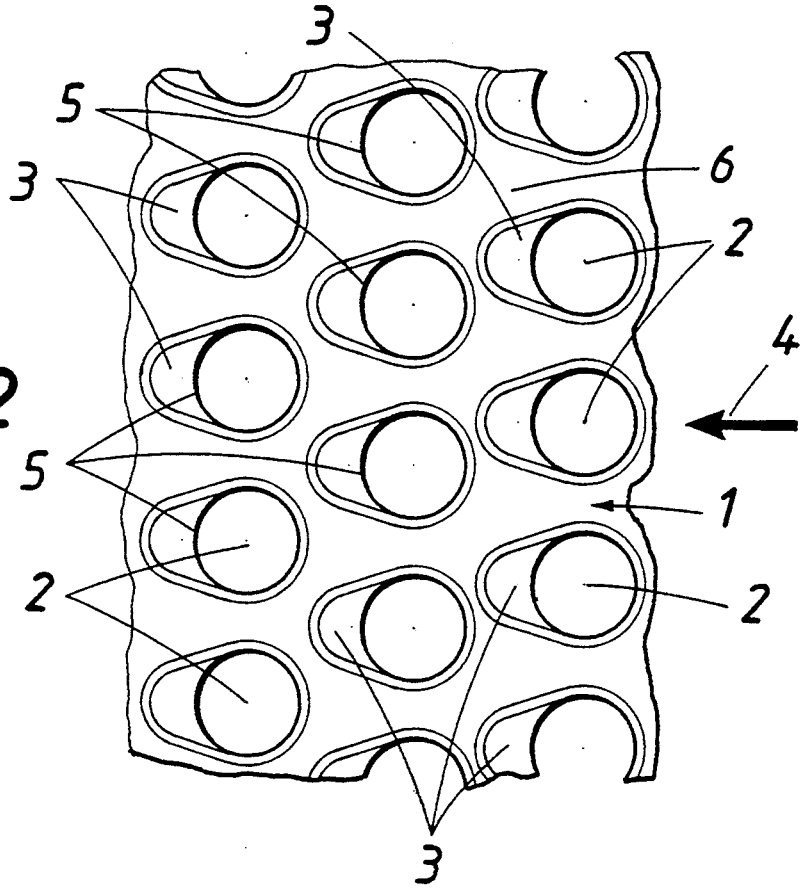
FIG. 2 is a top plan view showing the perforated plate of FIG. 1.

An embodiment of the invention will now be described more in detail with reference to the drawing.

The illustrated perforated plate 1 is intended to be used as a web-supporting plate in an apparatus for needling a nonwoven web. The plate is formed with conventional through holes 2 for receiving the needles when they have penetrated through the nonwoven web. A difference from the known perforated plates resides in that the through holes 2 are provided adjacent to recesses 3 formed in that flat surface of the plate which faces and contacts the nonwoven web. Said recesses adjoin the through holes 2 at those edge portions 5 thereof which are the downstream edge portions with respect to the downstream direction, which is the direction of travel 4 of the nonwoven web. The recesses taper gradually in the downstream direction to the planar surface of the plate, as is particularly apparent from FIG. 1. When the needles penetrate through the nonwoven web and enter the through holes 2 and displace fibers of the nonwoven web into the through holes, convex knobs will be formed on the adjacent surface of the nonwoven web in the through holes 2 and must be pulled out of the through holes as the travel of the nonwoven web is continued. The recesses 3 inclining toward the through holes 2 in an upstream direction intersect the surfaces defining the through holes 2 at the downstream edges 5 of the through holes and the resulting intersections are recessed from the planar surface 6 of the plate. As a result, the convex knobs formed on the surface of the nonwoven web can readily be pulled in the downstream direction along the recesses 3 out of the associated holes without a substantial increase of the withdrawing force so that the resistance to the pulling of the nonwoven web can be decreased and a more uniform needled nonwoven web can be made.

The recesses may be provided in various shapes because it is mainly essential to ensure that the convex knobs formed on the surface of the nonwoven web will be pulled along the recesses out of the through holes. For this reason the shape of the recesses will be determined mainly in consideration of the space which is available. It must be borne in mind that adjacent to the edge portions 5 of the through holes the recesses 3 must be so deep that the convex knobs of the nonwoven web can easily be pulled out of the holes and that the recesses must have a sufficiently gentle taper so that a sufficiently low resistance is presented to the pulling of the nonwoven web.

Figure 3:
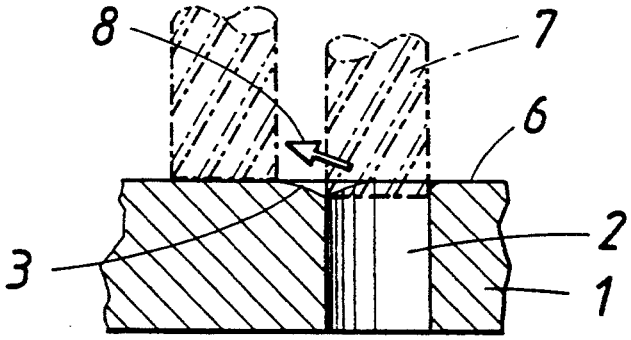
FIG. 3 is a view that is similar to FIG. 1 and shows in addition a drilling tool, which is used to make the recesses and is shown in two end positions of said tool.

FIG. 3 illustrates a method in which the recesses 3 can be made by means of the drilling tools 7 used to make the through holes 2, when the drilling tools 7 have entered the plate 1 to a depth corresponding to the desired largest depth of the recesses 3, said tools are pulled out of the drilled hole and are simultaneously moved in the direction of travel of the nonwoven web so that the drilling tools 7 move along a gently rising path, which is indicated by the arrow 8 and determines the inclination of the runout of the recesses.

It will be understood that the invention is not restricted to the embodiment shown by way of example. Whereas convex knobs will mainly be formed on that side of the nonwoven web on which the penetrating needles emerge out of the web, convex knobs may also be formed on the opposite surface of the nonwoven web as the needles are pulled out of the web. For this reason it may be desirable to form such recesses also in the perforated plate of the stripper. Besides, the recesses 3 may alternatively be constituted by grooves, which extend along each transverse row of holes and have an asymmetrical cross-section to provide the desired tamer. The recesses may alternatively be made in that the through holes 2 are drilled at a small angle to the adjacent planar broadside surface of the perforated plate adjacent to their trailing edge portions.

I claim:

1. A supporting plate for use in needling a nonwoven web in contact with a planar surface of the plate and pulled in a direction of travel from an upstream to a downstream end of the plate, (a) the supporting plate having a multiplicity of through holes having downstream edge portions, and (b) the planar plate surface at least adjacent the upstream plate end defining recesses eccentrically adjoining only the downstream edge portions of the through holes and extending therefrom in the downstream direction, (1) the recesses gently rising from the downstream edge portions of the through holes to the planar surface.

2. The supporting plate of claim 1, wherein the through holes are circular and a maximum width of the recesses at the downstream edge portions of the through holes, measured perpendicularly to the direction of travel, is equal to the diameter of the through holes.

* * * * *